United States Patent [19]

Suzuki

[11] 4,208,182

[45] Jun. 17, 1980

[54] PROCESS FOR TRANSFER PRINTING AT ELEVATED TEMPERATURES

[75] Inventor: Atsushi Suzuki, Toyko, Japan

[73] Assignee: Toyo Ink Manufacturing Co., Ltd., Tokyo, Japan

[21] Appl. No.: 768,931

[22] Filed: Feb. 15, 1977

[30] Foreign Application Priority Data

Feb. 17, 1976 [JP] Japan ..... 51-15500
Jul. 6, 1976 [JP] Japan ..... 51-79496

[51] Int. Cl.[2] ..... D06P 3/46; D06P 5/00
[52] U.S. Cl. ..... 8/471
[58] Field of Search ..... 8/2.5 R, 2.5 A, 63, 8/165

[56] References Cited

U.S. PATENT DOCUMENTS

| | | | |
|---|---|---|---|
| 2,911,280 | 11/1959 | Cicogna | 8/2.5 |
| 3,021,188 | 2/1962 | Conciatori | 8/165 |
| 3,101,236 | 8/1963 | Salvin et al. | 8/176 |
| 3,310,557 | 3/1967 | Kleeman | 8/165 |

FOREIGN PATENT DOCUMENTS

| | | | |
|---|---|---|---|
| 648651 | 1/1951 | United Kingdom | 8/165 |
| 1384546 | 2/1975 | United Kingdom | 8/2.5 A |

OTHER PUBLICATIONS

Salvin, V.S. et al., *Textile Research Journal*, vol. 25, No. 7, 1955, pp. 571–584.

Corbman, Textile: Fiber to Fabric, McGraw-Hill Co. New York, 1975, pp. 253–254 (Au 144).

*Primary Examiner*—Joseph L. Schofer
*Assistant Examiner*—Maria S. Tungol
*Attorney, Agent, or Firm*—Frank J. Jordan

[57] ABSTRACT

A process for the transfer printing of an acetate textile fabric or acetate film, which comprises pre-treating the acetate material with a nitrogen oxide gas-fading inhibitor and oxidation inhibitor to improve the resulting printed acetate material in fastness to gas fading, placing a transfer printing sheet on the thus pre-treated acetate material and then heating the transfer printing sheet to print the pre-treated acetate material by transfer thereto of the dye contained in the printing sheet.

3 Claims, No Drawings

PROCESS FOR TRANSFER PRINTING AT ELEVATED TEMPERATURES

This invention relates to an elevated-temperature transfer printing process and more particularly it relates to a process for applying disperse dye to an textile fabric or film by transfer of the disperse dye at an elevated temperature under atmospheric or a reduced pressure after the treatment of the textile fabric or film with a nitrogen oxide gas inhibitor as an anti-fading agent and oxidation inhibitor as anti-yellowing agent, respectively. The textile material used herein includes textile fabrics made of acetate (including diacetate and triacetate) fibers; textile fabrics made of acetate and other fibers; knitted goods made of acetate fibers; mixed spun, mixed woven and mixed knitted goods made of acetate and other fibers; or acetate films. The aforesaid textile material is hereinafter referred to as "acetate material" for brevity.

Conventional processes for applying disperse dye such as aminoanthraquinone dye to acetate material by transfer of the dye at an elevated temperature (such processes being hereinafter referred to simply as "transfer printing" processes) are disadvantageous in that (1) the aminoanthraquinone dye printed on the acetate material is liable to fade by contact with a nitrogen oxide gas, (2) there are not obtained printed materials which are comparable in color strength to printed polyester fibers and (3) the acetate material to be printed will be impaired in handling or feel by being dyed.

In order to prevent such printed materials from fading by such gas contact, there have been proposed processes comprising transferring dyestuffs to the acetate material at an elevated temperature and simultaneously treating it with a transferable inhibitor against fading with a nitrogen oxide gas by using transfer printing paper containing the transferable inhibitor (the inhibitor being hereinafter referred to simply as "gas-fading inhibitor"); however, these conventional processes have the disadvantages that transfer printing paper for use in printing the acetate material must be specifically prepared and, besides, the acetate material will be impaired in feel by being subjected to the transfer printing. In addition, there have also been known other conventional processes comprising transfer printing the acetate material and then treating the printed acetate material in a hot water bath containing the gas-fading inhibitor; these conventional processes have, on one hand, the advantage that the feel of the acetate material which was impaired by the transfer printing may be recovered to the original by the treatment of the printed acetate material in the gas inhibitor-containing water bath and, on the other hand, the disadvantage that the successive washing and drying operations will offset the advantage of the transfer printing.

Intensive studies had been made by the present inventor in an attempt to avoid the aforesaid disadvantages and, as a rsult of his studies, it has been found that the treatment of the acetate material with the gas-fading inhibitor prior to the transfer printing of the acetate material will result in the production of printed acetate material having excellent gas fastness and a color strength 2–3 times that of a printed acetate material obtained by transfer printing using the same transfer printing paper without a pre-treatment with the gas-fading inhibitor. It was quite unexpected in the transfer printing that the pre-treatment of the acetate material with the gas-fading inhibitor resulted in the production of a printed acetate material having a high color strength. The acetate material previously treated with the gas-fading inhibitor (the pre-treated acetate material being hereinafter sometimes referred to as "inhibitor-treated" acetate material) is advantageous in that it may be printed by the transfer printing at a lower temperature than is the case with the same acetate material not pre-treated with the gas-fading inhibitor in order to obtain the same dyeing or printing effect as said non-pretreated acetate material and that it may be so dyed with its feel being not impaired as compared with the same acetate material not pre-treated with the gas-fading inhibitor. It is the most desirable to carry out the transfer printing at a pressure lower than atmospheric pressure in order to retain the feel of the acetate material to be printed, and it is possible to select operational conditions under which the acetate material to be printed may be dyed by the transfer printing without impairing the feel thereof. For example, the inhibitor-treated acetate material was subjected to the transfer printing at a pressure of 50 Torr and a temperature of 175° C. for 40 seconds by the use of a continuous vacuum transfer printing machine (produced under the trademark of Arilovac CM 126 by Toyo Ink Mfg. Co., Ltd.) thereby to obtain a printed acetate material which was satisfactory in color strength, fastness to gas fading, and feel. More particularly, in spite of the fact that the inhibitor-treated acetate material was dyed by the transfer printing thereby to yield a novel printed acetate material having a higher color strength than a comparative printed acetate material obtained by the transfer printing of a comparative acetate material which was the same as said inhibitor-treated acetate material except that the comparative acetate material was not pre-treated with the gas-fading inhibitor, the novel printed acetate material was equally satisfactory or somewhat superior in fastness to light, washing, rubbing and persperation to the comparative printed acetate material.

The gas inhibitors used in the invention contain a commercially available aromatic amino compound as the main ingredient and they include Inhibitor-Maulin PT-3N, Maulin P-4D and Maulin PT-2 (each trademark, produced by Maulin Kagaku Kogyo Co., Ltd.), Nikkahibitor-S and Nikkahibitor-D (each trademark, produced by Nikka Kagaku Co., Ltd.), Gasguard DX (trademark, produced by Meisei Kagaku Kogyo Co., Ltd.), Gasnon M, Gasnonsuper M, Gasnonhighlyconc (each trademark, produced by Nippon Senko Kogyo Co., Ltd.), Neohobitor-T (trademark, produced by Ipposha Yushi Co., Ltd.) and Antifume-T (trademark, produced by Sumida Kagaku Kogyo Co., Ltd.). In addition, aromatic and aliphatic amino compounds which are compatible with, or affinitive to, acetate fibers are also effective as the gas-fading inhibitor.

The method by which the acetate material to be treated is contacted with the gas-fading inhibitor according to this invention may be similar to a conventional method usually employed; for example, the acetate material may be immersed in a hot water bath containing the gas-fading inhibitor for 20–30 minutes.

In the practice of this treatment, the amount of the gas-fading inhibitor dispersed in the hot water bath may be in the range of 0.5–200%, preferably 2–50%, by weight of the acetate material to be treated.

However, the acetate material pre-treated with the known gas-fading inhibitor often tends to turn yellowish later.

In general, textile materials such as acetate, polyester and polyamide textile fabrics, have recently been treated with the gas-fading inhibitor in the course of their dyeing in order to produce dyed textile materials having improved fastness to gas fading. There have heretofore been proposed a sublimation transfer printing process for carrying out transfer printing and gas-fading inhibitor treatment using a gas-fading inhibitor-containing transfer printing paper (Japanese Patent Appln. Laying-Open Gazettes Nos. 32913/72 and 73583/73,) a process further comprising the steps of steaming and soaping (Japanese Patent Appln. Laying-Open Gazette No. 118984/74), and like processes.

The aforesaid known gas-fading inhibitor treatment is certainly useful in improving fastness to gas fading; however, textile materials treated with the gas-fading inhibitor are disadvantageous in that they will yellow later at the non-dyed and light colored portions thereof. Such a disadvantage is particularly remarkable in textile material dyed at an elevated temperature, as for example dyed by transfer printing. In addition, textile material, such as the acetate material, pre-treated with the gas-fading inhibitor but not dyed yet, will yellow during the storage thereof for a long period of time whereby the textile material so pre-treated is depreciated in commercial value. Thus, this depreciation has been a problem to be solved.

Intensive studies had also been made in an attempt to solve said problem and, as a result of the studies, it has been found that the pre-treatment of textile material with the oxidation inhibitor and with the gas-fading inhibitor will inhibit the resulting dyed textile material from yellowing without exerting adverse effects on the feel, fastness to gas fading, and other fastnesses, as well as on the chromogenic ability of the dyed used. The present invention is also based on this finding.

One of the characteristics of the present invention is to effect the gas-fading inhibitor treatment and the oxidation inhibitor treatment on material to be dyed prior to dyeing thereof thereby to improve the resulting dyed material in fastness to gas fading.

The oxidation inhibitors used herein are known ones including quinones such as hydroquinone, amines such as phenyl-$\beta$-naphthylamine and aldehyde-amine condensates, vitamin C, vitamin E, dibutyloxytoluene, butyloxyanisole, ethyl protocatechuate, isoamyl gallate, propyl gallate, guaiac (resin), nordihydroguaiaretic acid and $\beta$-naphthol. These oxidation inhibitors may be used jointly with citric acid, phosphoric acid or the like as an adjuvant therefor. The oxidation inhibitors now marketed include those which are supplied under the trademark of Sumirizer BHT and Sumirizer MDP by Sumitomo Chemical Industrial Co., Ltd., Japan. Among the oxidation inhibitors, those used as an antioxidant for foodstuffs are preferred from the view-point of sanitation.

The oxidation inhibitors may be used in an amount of 0.01–3%, preferably 0.01–1%, by weight of the acetate material.

The gas-fading inhibitors and the oxidation inhibitors may be dissolved or dispersed in a solvent such as water or an alcohol, to form a solution or dispersion thereof; the acetate material to be dyed is pre-treated with the solution or dispersion by being immersed therein or sprayed therewith in a conventional manner. They may also be used jointly with various other conventional treating agents such as levelling, softening and thickening agents.

The dyes which may preferably be used for the transfer printing of the acetate material, are disperse dyes capable of sublimating at a temperature of 100°–250° C. and include C.I. Disperse Yellow 3, Yellow 5, Yellow 7, Yellow 8, Yellow 51, Orange 3, Orange 7, Orange 13, Red 1, Red 4, Red 11, Red 13, Red 15, Red 31, Red 60 Violet 1, Violet 4, Violet 8, Violet 37, Violet 59, Blue 3, Blue 9, Blue 14, Blue 19, Blue 22, Blue 24 and Blue 54.

According to this invention, therefore, transfer printing paper marketed for use for polyesters may be used for the purpose of obtaining printed acetate material having a satisfactory color strength and various excellent fastnesses such as fastness to gas fading.

This invention will be better understood by the following non-limitative Examples wherein all percentages are by weight unless otherwise specified.

EXAMPLE 1

A triacetate textile fabric was immersed in a bath containing a gas-fading inhibitor (Nikkahibitor-S) in an amount of 5% by weight of the triacetate textile material and being solwly raised in temperature, and then treated with the bath at 70°–80° C. for about 30 minutes, after which the triacetate textile material so treated was washed with water, dried and subjected to transfer printing using transfer printing paper having thereon a design containing C.I. Disperse Blue 54, at a pressure of 50 Torr and a temperature of 175° C. for 40 seconds thereby to yield a novel attractive printed triacetate textile material without impairing the feel of the original textile material. For comparison, the same procedure as above was followed except that the inhibitor-treated triacetate textile material was substituted by a triacetate textile material which was different from the former in that the latter was not pre-treated with a gas inhibitor, thereby yielding a comparative printed triacetate textile material. The comparison of properties between the novel and comparative printed products is indicated in Table 1.

Table 1

| | | Novel printed textile material | Comparative printed textile material |
|---|---|---|---|
| Color strength* | | 1.19 | 0.75 |
| Fastness to gas fading | | 5 | 1–2 |
| Light | | 5 | 5 (Fade-O-meter, 20 hours' exposure) |
| Washing | | 4 | 4 |
| Perspiration | : Acidic | 4 | 4 |
| | : Alkaline | 4 | 4 |
| Rubbing | : Dry | 5 | 5 |
| | : Wet | 4 | 4 |

*Measured by GRETAG Densitometer produced by GRETAG INC.

EXAMPLE 2

A diacetate textile material was padded with a 7% solution of a gas inhibitor at 70°–80° C. (the gas inhibitor being supplied under the trademark of Inhibitor-Maulin P-4NN (pickup about 40%) produced by Maulin Chemical Industrial Co., Ltd.) and then dried at 80°–100° C.

The diacetate textile material so treated and a transfer printing paper with thereon a desired design layer of a black ink containing C.I. Disperse Blue 19, were placed one upon another with the design facing to the textile material and then heated to 180° C. at atmospheric pressure for 30 seconds to effect transfer printing on the textile material thereby obtaining a novel printed diacetate textile material having thereon a satisfactorily concentrated design and satisfactory feel. For comparison, the same procedure as above was repeated except that the pre-treatment with the gas inhibitor was omitted, thereby to obtain a comparative printed diacetate textile material.

The comparison of properties between the novel and comparative printed textile materials is shown in Table 2.

Table 2

| | Novel printed textile material | Comparative printed textile material |
|---|---|---|
| Color strength* | 1.87 | 1.54 |
| Fastness to gas fading | 4–5 | 1–2 |
| Light | 4 | 4 |
| Washing | 4 | 4 |
| Perspiration : Acidic | 4 | 4 |
| : Alkaline | 4 | 4 |
| Rubbing : Dry | 4 | 4 |
| : Wet | 4 | 4 |

*Measured by GRETAG Densitometer produced by GRETAG INC.

EXAMPLE 3

A triacetate textile material was immersed in a bath containing 6 wt.% of Nikkahibitor-S as the gas inhibitor and 0.5 wt.% of Sumirizer-BHT as the oxidation inhibitor, each based on the weight of triacetate textile material, the bath being slowly raised in temperature to 70°–80° C. The thus-treated triacetate textile material was further treated with the bath at this temperature for about 30 minutes, washed with water and dried. The treated triacetate textile material so dried and a sublimation transfer printing paper were placed one upon another with the dye-containing side of the paper facing to the triacetate material and then heated to 190° C. at 200 g/cm$^2$ for 35 seconds to obtain a novel dyed product which had no tendency to yellow with the lapse of time and was equal in fastness to gas fading to a dyed product obtained by repeating the aforesaid procedure except that the oxidation inhibitor was omitted.

EXAMPLE 4

A diacetate cloth was treated with a bath in which were dispersed 5 wt.% of Nikkahibitor-S and 5.0 wt.% of Sumirizer-MDP, each based on the weight of acetate cloth, in the same manner as in Example 3 to obtain a novel dyed product which was confirmed to be inhibited from yellowing.

EXAMPLE 5

The triacetate textile material pre-treated with the gas inhibitor and oxidation inhibitor but not dyed yet in Example 3 was stored at a constant temperature of 40° C. for three months with the result that the pre-treated textile material was not found to turn yellow in color. In addition, a dyed product obtained by subjecting said pre-treated but non-dyed textile material to transfer printing under the same conditions as in Example 1, exhibited substantially the same fastness to gas fading as said pre-treated but non-dyed textile material and was not found yellowed.

Comparative example 1

Following the procedure of Example 3 except the treatment with the gas inhibitor was omitted, there was obtained a dyed product which exhibited improved fastness to gas fading but was found yellowed at the non-dyed portion thereof three months later thereby to depreciate its commercial value.

What is claimed is:

1. A process for applying disperse dye to an acetate textile fabric or acetate film comprising the steps of:

pre-treating the acetate material with a gas-fading inhibitor against a nitrogen oxide gas, which inhibitor is an aliphatic or aromatic amino compound, placing a transfer printing sheet having thereon a desired design layer containing disperse dye on the thus pre-treated acetate material with the design layer facing thereto and then, as the final step, printing the pre-treated acetate material by sublimation transfer of the disperse dye in the form of the design at an elevated temperature.

2. A process according to claim 1, wherein the pre-treatment is effected in a hot water bath containing the gas-fading inhibitor against a nitrogen oxide gas in an amount of 0.5–200% by weight of the acetate material to be treated and the printing is effected at a temperature of 100°–250° C.

3. A process according to claim 1, wherein the sublimation transfer printing is carried out at a pressure lower than atmospheric pressure.

* * * * *